US005720326A

United States Patent [19]

Kaneko

[11] Patent Number: 5,720,326

[45] Date of Patent: Feb. 24, 1998

[54] METHOD AND APPARATUS FOR FILLING A CONTAINER WITH REDUCED MIXING OF PRODUCT AND AIR

[75] Inventor: Yutaka Kaneko, Wheeling, Ill.

[73] Assignee: Tetra Laval Holdings & Finance S.A., Pully, Switzerland

[21] Appl. No.: 617,683

[22] Filed: Mar. 19, 1996

[51] Int. Cl.[6] ..... B65B 1/04

[52] U.S. Cl. ..... 141/114; 141/67; 141/172; 141/275; 141/374

[58] Field of Search ..... 141/114, 13, 25, 141/44, 46, 47, 49, 50, 67, 68, 172, 173, 275, 374; 222/490, 494; 239/DIG. 12, 533.13, 602

[56] References Cited

U.S. PATENT DOCUMENTS

| | | | |
|---|---|---|---|
| 2,761,605 | 9/1956 | Pahl et al. | 222/490 |
| 3,195,786 | 7/1965 | Vogt . | |
| 3,260,285 | 7/1966 | Vogt | 141/67 |
| 3,568,733 | 3/1971 | Lau . | |
| 4,457,125 | 7/1984 | Fishburne . | |
| 5,022,443 | 6/1991 | Warner | 141/374 |
| 5,212,931 | 5/1993 | Hartmann . | |
| 5,265,654 | 11/1993 | Larsen . | |
| 5,275,215 | 1/1994 | Derby . | |
| 5,309,961 | 5/1994 | Franke et al. | 222/490 |
| 5,449,028 | 9/1995 | Sindoni . | |

*Primary Examiner*—David J. Walczak
*Assistant Examiner*—Steven O. Douglas
*Attorney, Agent, or Firm*—McAndrews, Held & Malloy, Ltd.; Michael A. Catania

[57] ABSTRACT

A method and an apparatus for filling a container with product are set forth which assist in reducing the mixing of air and product as the product is dispensed into the container. In accordance with one embodiment of the apparatus, the apparatus comprises a fill pipe for communicating a product therethrough to a fill opening of the fill pipe. A flexible dispensing receptacle having a first end disposed about the fill opening of the fill pipe for receiving product communicated through the fill pipe. The flexible receptacle is capable of being filled with a volume of product that is substantial when compared to the volume of product that is to be dispensed into a single container. Further, the flexible receptacle is dimensioned to facilitate its insertion into the interior of the container. A pressure actuated nozzle is disposed at a second end of the flexible receptacle through which product is dispensed into the container. Various modifications and enhancements to this basic apparatus are also contemplated. In accordance with one embodiment of the method, the method comprises the steps of 1) filling a flexible receptacle with a volume of product; 2) inserting the flexible receptacle into the container; and 3) dispensing product from the flexible receptacle into the container.

16 Claims, 8 Drawing Sheets

Fig. 8
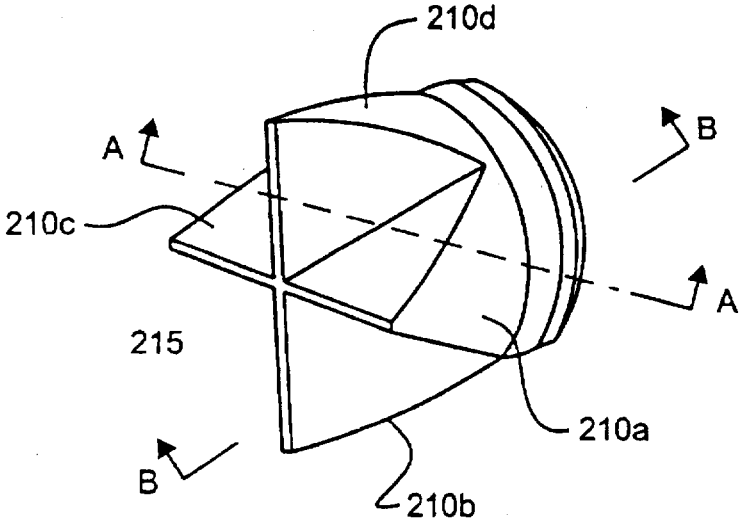
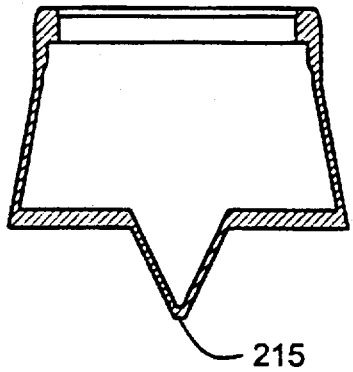
Fig. 8A
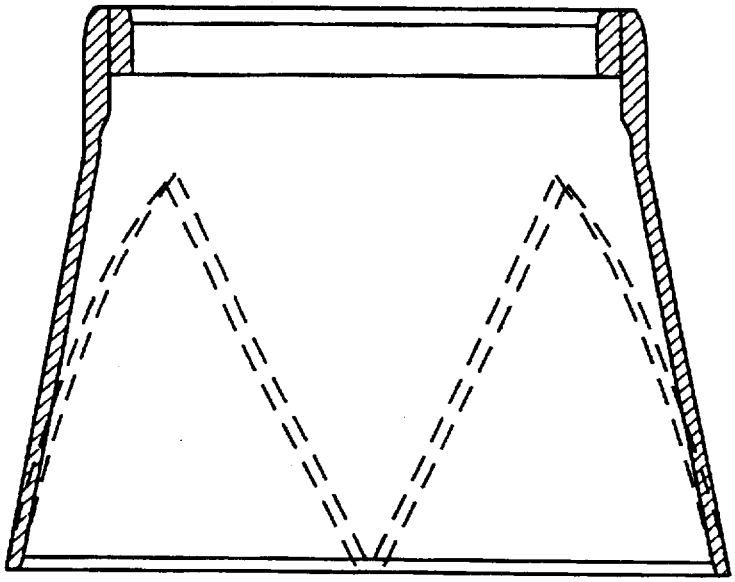
Fig. 8B

METHOD AND APPARATUS FOR FILLING A CONTAINER WITH REDUCED MIXING OF PRODUCT AND AIR

TECHNICAL FIELD

The present invention relates to a method and apparatus for filling a container, such as a gable-top carton. More specifically, the present invention relates to a method and apparatus for filling a container wherein there is a reduction in the mixing of product and air when product is dispensed into the container.

BACKGROUND

Packaging machines are known that integrate the various components necessary to fill and seal a container into a single machine unit. This packaging process, generally stated, includes feeding carton blanks into the machine, sealing the bottom of the cartons, filling the cartons with the desired contents, sealing the tops of the cartons, and then off loading the filled cartons for shipping.

Trends within the field of packaging machines point toward increasingly high capacity machines intended for rapid, continuous filling and sealing of a very large number of identical or similar packaging containers, e.g., containers of the type intended for liquid contents such as milk, juice, and the like. One such machine is disclosed in U.S.S.N. 08/190,546, filed Feb. 2, 1994. The machine disclosed in the '546 application includes a plurality of processing stations, each station implementing one or more processes to form, fill, and seal the containers. Each of the processing stations is driven by one or more servomotors that drive the various components of each of the processing stations.

The increased throughput and decreased size requirements of packagers on their packaging machines have increased the demands that are placed on the fill systems that are employed. Various apparatus and corresponding methods for filling containers, such as gable-top containers, have therefor been devised for these machines. In accordance with one of the more popular filling methods, the container is lifted from a conveyor to a fill pipe by means of a lifting mechanism. The container lifting mechanism gradually lowers the container as product is dispensed through the fill tube. The container then again engages the conveyor where it is transported to a top sealing station. Such a method is utilized in TR/7™ and TR/8™ packaging machines manufactured and available from Tetra Pak, Inc.

Alternatively, the filling and top sealing operations may be performed at a single location within the machine. In such instances, the container may be top sealed after it has been lowered from the fill pipe. Such a method and apparatus are shown and described in the foregoing '546 application, and, further, in U.S.S.N. 08/315,414, filed Sep. 28, 1994, and entitled "Control System For A Packaging Machine".

One problem encountered when attempting to increase the speed with which a container is filled with product relates to the foaming that occurs as a result of air and product mixing in the container. Generally stated, foaming increases as the speed with which the container is filled increases. When foaming is excessive, the product splashes into the sealing areas of the container resulting in improper sealing in subsequent sealing operations and/or contamination of the sealing area resulting in a reduction in the hygiene of the seal than would otherwise be obtained. The rate at which the container may be filled is thus limited by the foaming that occurs for a given fill rate.

SUMMARY OF THE INVENTION

A method and an apparatus for filling a container with product are set forth which assist in reducing the mixing of air and product as the product is dispensed into the container. In accordance with one embodiment of the apparatus, the apparatus comprises a fill pipe for communicating a product therethrough to a fill opening of the fill pipe. A flexible dispensing receptacle having a first end disposed about the fill opening of the fill pipe for receiving product communicated through the fill pipe. The flexible receptacle is capable of being filled with a volume of product that is substantial when compared to the volume of product that is to be dispensed into a single container. Further, the flexible receptacle is dimensioned to facilitate its insertion into the interior of the container. A pressure actuated nozzle is disposed at a second end of the flexible receptacle through which product is dispensed into the container. Various modifications and enhancements to this basic apparatus are also contemplated.

In accordance with one embodiment of the method, the method comprises the steps of 1) filling a flexible receptacle with a volume of product; 2) inserting the flexible receptacle into the container; and 3) dispensing product from the flexible receptacle into the container. As is the case with the apparatus, various modifications and enhancements to this basic method are also contemplated.

Other objects and advantages of the present invention will become apparent upon reference to the accompanying detailed description when taken in conjunction with the following drawings.

BRIEF DESCRIPTION OF THE DRAWINGS

FIGS. 8, 8A, and 8B are various views of a nozzle suitable for use in the combination of the present invention.

DETAILED DESCRIPTION OF THE PREFERRED EMBODIMENT

Figures 1A, 1B:
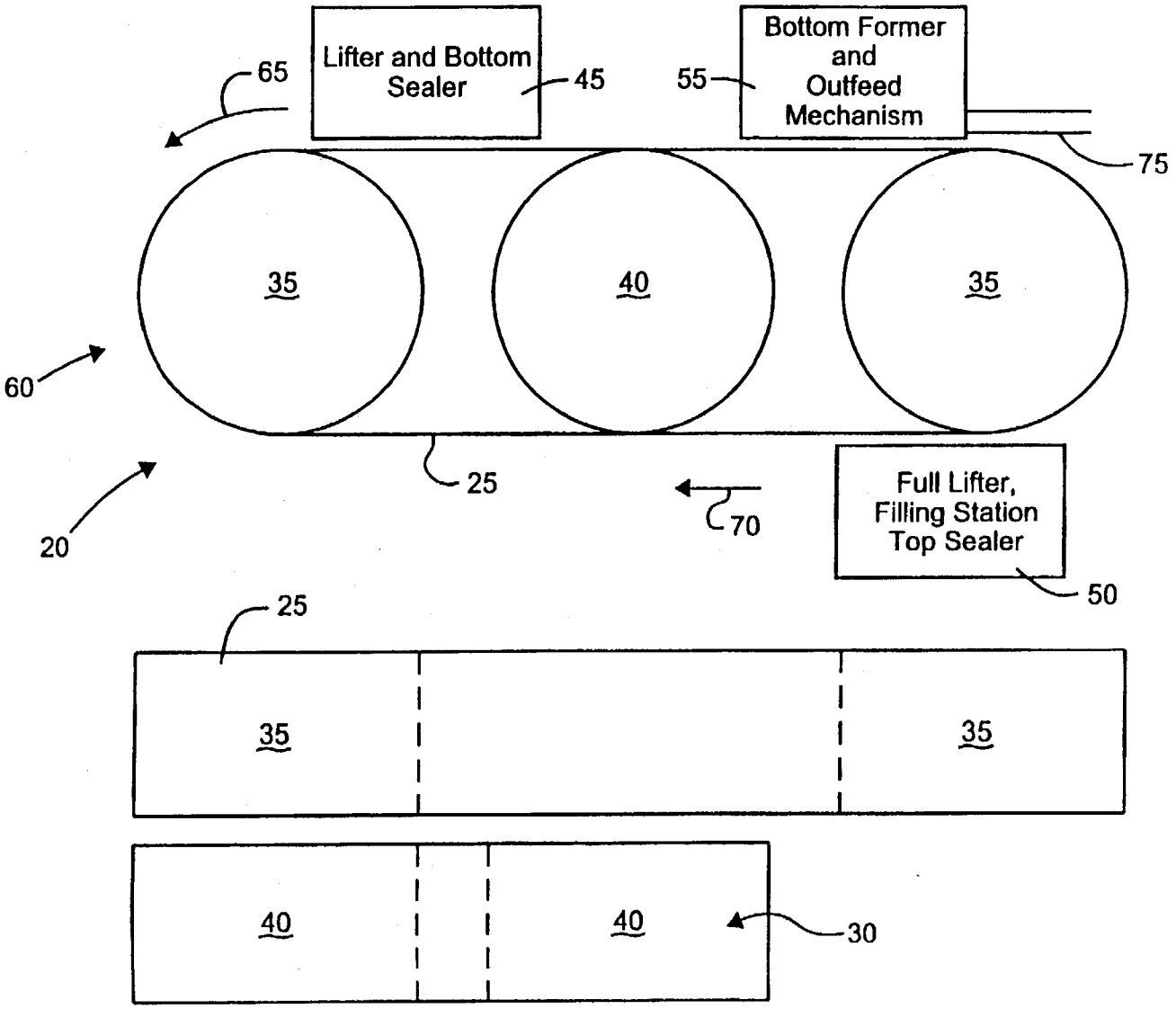
FIGS. 1A and 1B are schematic illustrations of one embodiment of a packaging machine system that can utilize the fill system of the present invention.

FIGS. 1A and 1B are schematic illustrations of a packaging machine system such as the one disclosed in the aforementioned '546 application. The packaging system, shown generally at 20, includes an upper endless belt conveyor 25 and a lower endless belt conveyor 30. The upper endless belt conveyor 25 is driven by a pair of pulley wheels 35 that, for example, are driven by one or more servomotors. The lower endless belt conveyor 30 is also driven by a pair of pulleys 40 that, for example, may be servomotor driven. The conveyors may be constructed in accordance with the teachings of U.S.S.N. 08/282,981, filed Jul. 29, 1994, incorporated herein by reference.

A plurality of processing stations 45, 50, and 55 are disposed about the periphery of the endless belt conveyors 25 and 30. The processing stations 45, 50, and 55 each have their respective mechanical components driven by one or more servomotors that control the motion profile of the station components.

The lower conveyor 30 may receive erected carton blanks at end 60 and transport the carton blanks to processing station 45. Processing station 45 may include a lifter mechanism and a bottom sealer mechanism. The lifter mechanism may be constructed in accordance with the teachings of U.S.S.N. 08/315,410, filed Sep. 28, 1994, entitled "Belt Driven Linear Transport Apparatus for a Packaging Machine", and U.S.S.N. 08/315,401, also filed in Sep. 28, 1994, entitled "Lifter Mechanism Employing a Carton Gripper and Carton Bottom Seal Configuration for Same". The bottom sealer mechanism may be constructed in accordance with the teachings of U.S.S.N. 08/314,412, filed Sep. 28, 1994, entitled "Ultrasonic Carton Sealer". Both the lifter mechanism and the bottom sealer mechanism are driven by respective servomotors.

In operation, the lifter mechanism transports the erected cartons in groups from the lower conveyor 30 to the upper conveyor 25. At the upper conveyor 25, the bottoms of the cartons are sealed, for example, with previously noted sealing apparatus using ultrasonic energy.

The upper conveyor 25 transports the cartons in the direction indicated by arrow 65 to processing station 50. Processing station 50 may include a fill lifter mechanism, a plurality of filling nozzles respectively associated with each of the cartons, and a top sealer. The fill lifter may be constructed in accordance with the teachings of the aforementioned '410 application and '401 application, while the top sealer may be constructed in accordance with the teachings of the aforementioned '412 application. At processing station 50, the fill lifter lifts the cartons to a position proximate the fill nozzles and gradually lowers the cartons as product is dispensed into them. Once the cartons have been filled, the top sealer seals the carton into the familiar gabled top configuration.

After the tops of the cartons have been sealed, the upper conveyor 25 transports the cartons in the direction of arrow 70 to processing station 55. Processing station 55 may include a bottom forming mechanism and an outfeed mechanism. The bottom forming mechanism, for example, may be constructed in accordance with the teachings of U.S.S.N. 08/315,403, entitled "Vacuum Operated Bottom Former", filed Sep. 28, 1994, and the outfeed mechanism may be constructed in accordance with the teachings of either U.S.S.N. 08/315,409, entitled "Apparatus for Transferring Containers to a Moving Conveyor") or U.S.S.N. 08/315,404, likewise entitled "Apparatus for Transferring Containers to a Moving Conveyor", both of which were filed on Sep. 28, 1994. At processing station 55, the bottom forming mechanism forms the bottom of the cartons to allow them to sit properly in an erect state. After the bottoms have been formed, the outfeed mechanism transfers the cartons to a distribution system, shown here as a single line conveyor 75.

Figure 2:
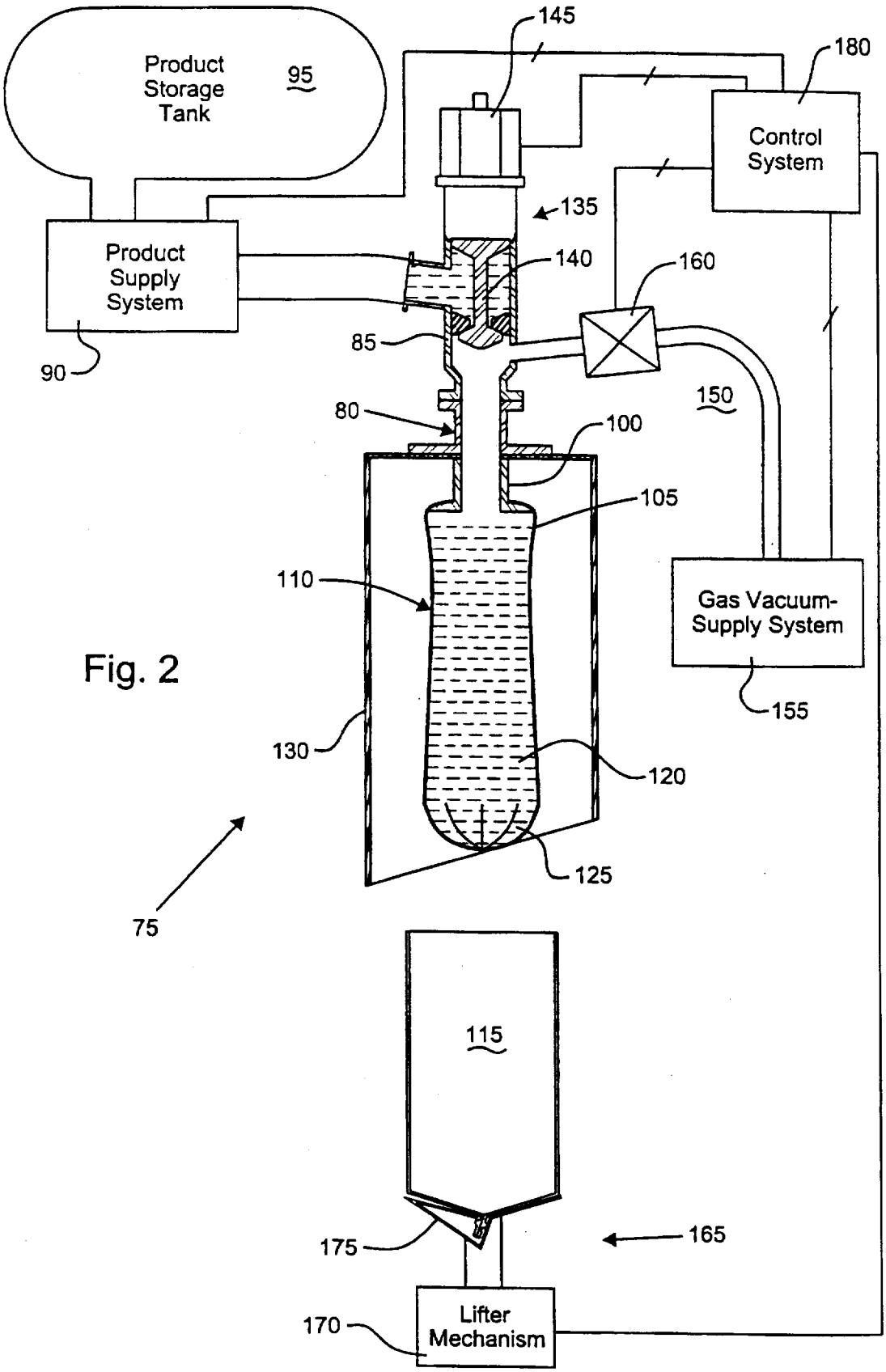
FIG. 2 is a diagram, in partial cross-section, of one embodiment of the present invention.

One embodiment of a system that may be utilized at processing station 50 is set forth in connection with FIG. 2. As illustrated, the system, shown generally at 75, includes a fill pipe 80 having a first end 85 in controlled fluid communication with a product supply system 90 and a corresponding product storage tank 95. The fill pipe 80 also includes a second end 100 in fluid communication with a first end 105 of a flexible dispensing receptacle 110. The flexible dispensing receptacle 110 has a cross section that allows it to be inserted into the interior portion of a container that is to be filled, illustrated here at 115. In the presently described embodiment, the container 115 is a gable top container and, for example, may be constructed in accordance with the teachings of U.S. Pat. No. 5,474,232, issued Dec. 12, 1995, and entitled "Gable Top Carton Blank With Curved Side Creases". The flexible dispensing receptacle 110 is capable of holding the entire volume of product that is to be dispensed into the container 115. It will be recognized, however, that the receptacle 115 itself may hold less than the total container volume of product, the remaining volume of product being disposed in the fill tube 80.

A second end 120 of the flexible dispensing receptacle 110 includes a nozzle 125. The nozzle 125 and body of the receptacle 110 may be, for example, formed in separate manufacturing operations and subsequently joined to one another. Alternatively, the nozzle 125 may be formed integrally with the other portions of the flexible dispensing receptacle 110.

In accordance with one embodiment of the receptacle 110, the nozzle 125 may be a pressure actuated nozzle that is biased to a closed position and opens upon application of a predetermined pressure. Subsequent descriptions of the operation of the system 75 will presume that a pressure actuated nozzle is employed. It will be recognized, however, that other nozzle configurations may likewise be used.

The flexible dispensing receptacle 110 extends into a cleaning box 130 that, for example, may be constructed in accordance with the teachings of U.S.S.N. 08/315,958, filed Sep. 30, 1994, and entitled "Tank Venting Apparatus For A Packaging Machine". The cleaning box 130 may be disposed in a generally hygienic portion of the packaging machine and may include inlets for sterile air supplied from a sterile air source (not shown).

Flow of product generally starts in the product storage tank 95 and proceeds into the product supply system 90. The product supply system 90 comprises, for example, pumping and dosing components that operate under the influence of analog and/or digital control signals.

A valve assembly 135 is interposed between the product supply system 90 and the flexible dispensing receptacle 110 to control the flow of product therebetween. In the illustrated embodiment, the valve assembly 135 includes a piston valve head 140 that is driven by a linear actuator 145.

A pressurization system, shown generally at 150, may optionally be employed to further effect a reduction in product/air mixing. As shown, the pressurization system 150 includes a gas vacuum-supply system 155 and a valve assembly 160. The gas vacuum-supply system 155 is operable to alternatively generate an underpressure and/or overpressure in the flexible dispensing receptacle 110 and is preferably designed to ensure hygienic operation of the system 75. The gas that is used within the pressurization system 150 may be an inert gas, carbon dioxide, nitrogen, or another gas, particularly chosen dependent on the type of product to be filled. Alternatively, and for purposes of the following discussion, the gas will be presumed to be air.

A lifter system, shown generally at 165, is provided to lift the container 115, such as a gable-top container, relative to the flexible dispensing receptacle 110. The lifter system 165 of the exemplary embodiment includes a lifter mechanism 170 and a carton gripper 175. The lifter mechanism 170 and carton gripper 175, may be constructed in the manner set forth in the '401 and '410 applications referenced above. It will be readily recognized that other, more conventional lifter systems may be employed. Additionally, relative movement between the container 115 and the flexible dispensing receptacle 110 may be accomplished by a mechanism that lowers the flexible dispensing receptacle 110 into the container 115 as opposed to lifting the container 115 to insert the receptacle 110.

Coordination of the operation of the product supply system 90, valve assembly 135, pressurization system 150, and the lifter system 165 may be, for example, controlled by a central control system 180. One example of a control system suitable for use in the present embodiment is shown and described in referenced '414 application. It will be recognized, however, the such coordinated movement need not be under a central control, but, rather, may be accomplished through conventional cam drives and/or one or more programmable logic controllers, or the like.

Figure 3:
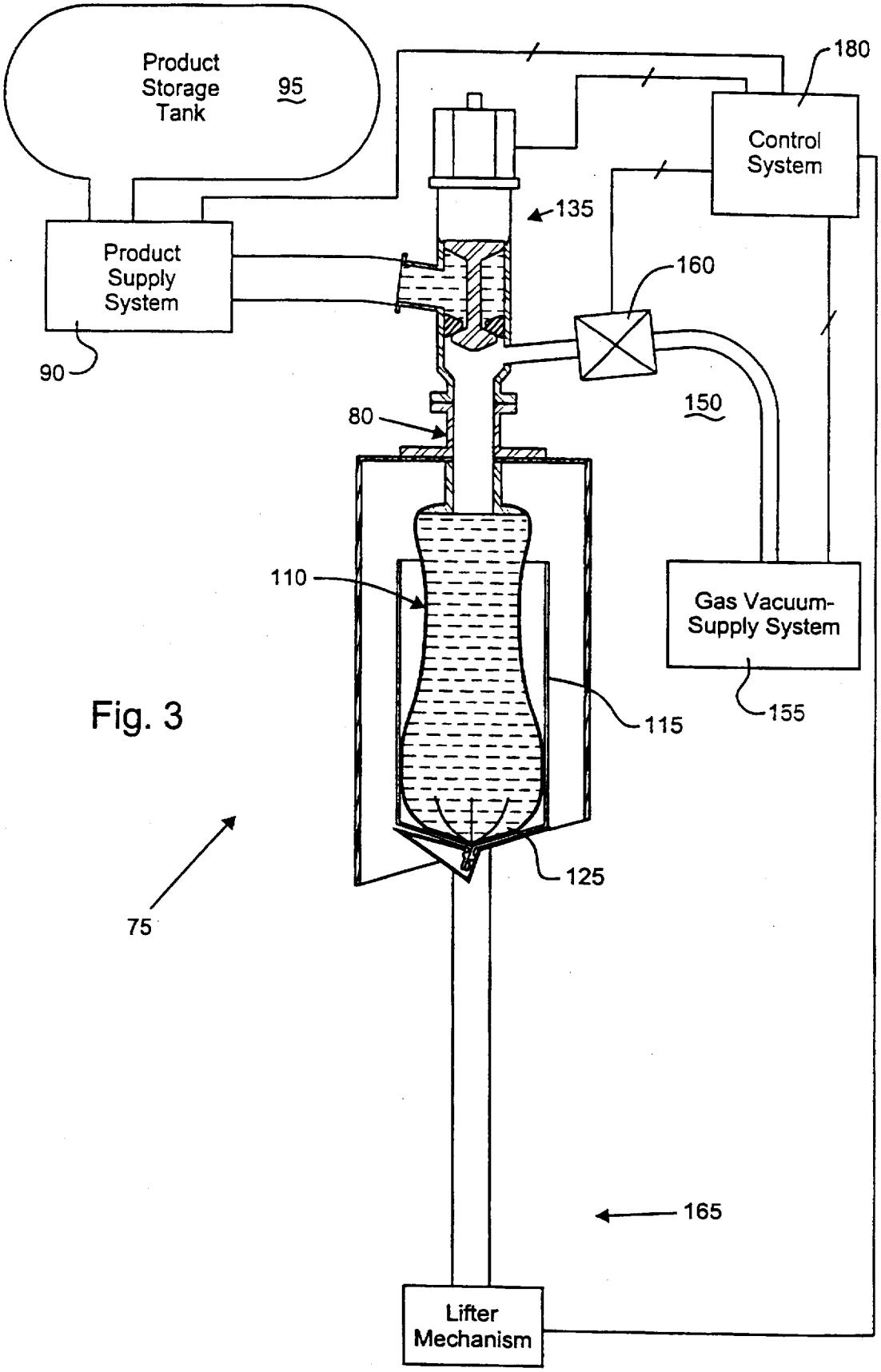
FIGS. 3–7 illustrated the system of FIG. 2 during various states of operation.

One manner of operation of the disclosed system is described in connection with FIGS. 3–6. As shown in FIG. 3, the product contained in the container is generally settled at a predetermined level. The container 115 is raised so that the flexible dispensing receptacle 110 is inserted into the interior of the container 115. The container 115 and receptacle 110 may preferably engage one another in the illustrated manner so that the sidewalls of the receptacle 110 engage the sidewalls of the container 115. The engagement limits the amount of air in the area proximate the nozzle, thereby limiting the amount of air that is displaced when the product is dispensed into the container 115. This manner of engagement further assists in reducing the potential for foam through air/product mixing.

Figure 4:
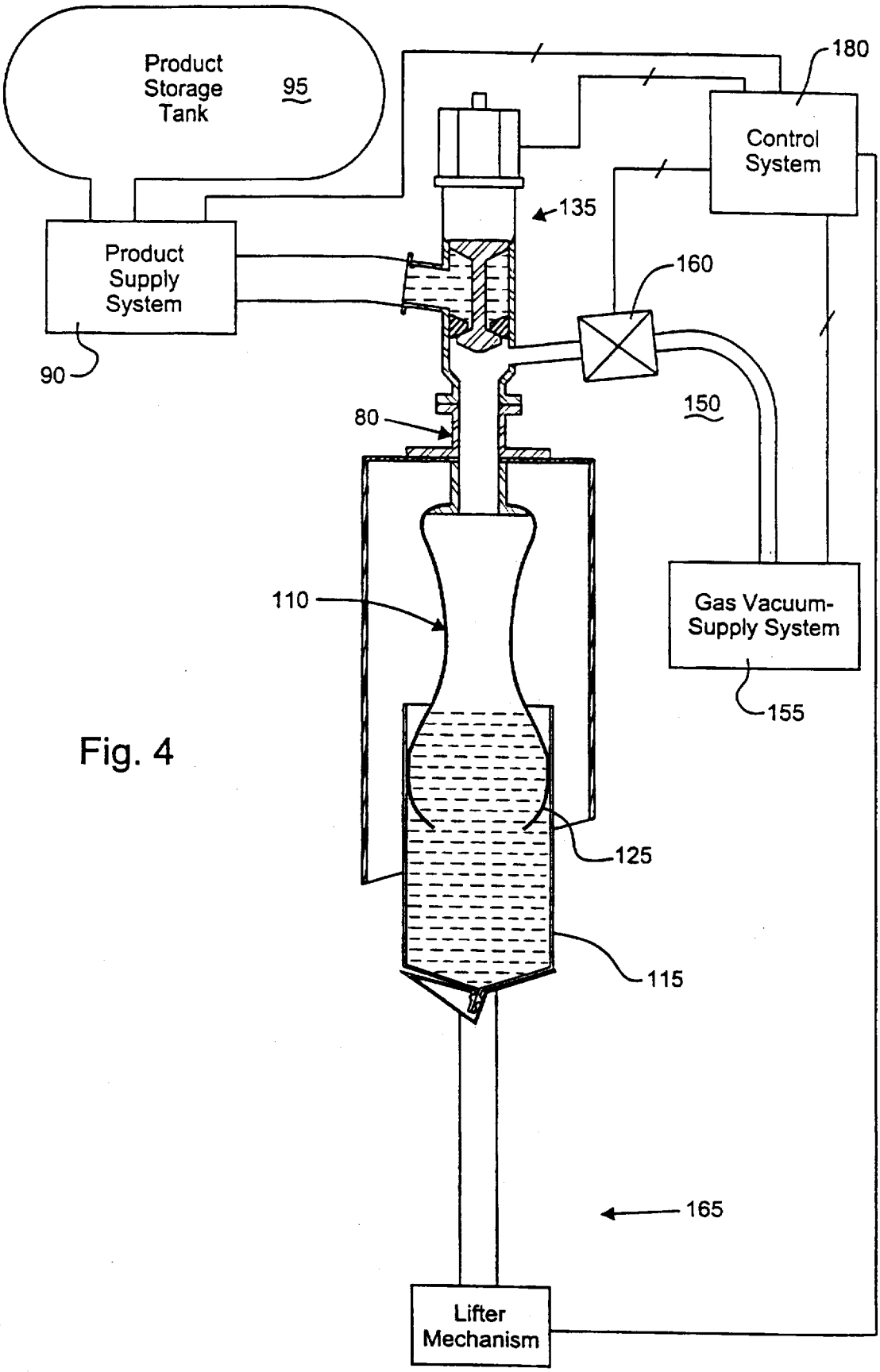

With reference to FIG. 4, the nozzle 125 is actuated to allow product to flow from the flexible dispensing receptacle 110 into the container 115. Such actuation is dependent upon the particular type of nozzle utilized. In the present exemplary embodiment, a pressure actuated nozzle is employed. The nozzle 125 may therefor be opened in response to a predetermined pressure level. The predetermined pressure level may be attained by opening the valve 160 and generating a pressurized condition, for example, an overpressure condition, within the receptacle 110 using the gas-vacuum supply system 155.

As product is dispensed from the receptacle 110 into the container 115, the container is gradually lowered by the lifter system 165 in accordance with a predetermined motion profile that, for example, is determined through programming in the control system 180. During the lowering process, it is again preferable to have the sidewalls of the receptacle 110 in contact with the sidewalls of the container 115. Such contact may be achieved by shaping the receptacle 110 and nozzle 125 so that the nozzled end of the receptacle conforms to the interior of the container 115 when the nozzle 125 is opened. Alternatively, or in addition to such shaping, the contact may be achieved by controlling the pressure applied by the pressurization system 150 so that the pressure is gradually increased as product is dispensed from the receptacle 110 to thereby urge the sidewalls of the receptacle against the sidewalls of the container.

After the container 115 has been filled, it may be top sealed at the site of the system 75, for example, at station 50 of FIG. 1A. The components of such a top sealing apparatus suitable for such use is disclosed in the referenced '412 application. Alternatively, the filled container 115 may be transported to a further processing station of the packaging machine for top sealing. In either instance, the filled container is transported from the site of the system 75 and a further container 115' is positioned for filling.

Figure 5:
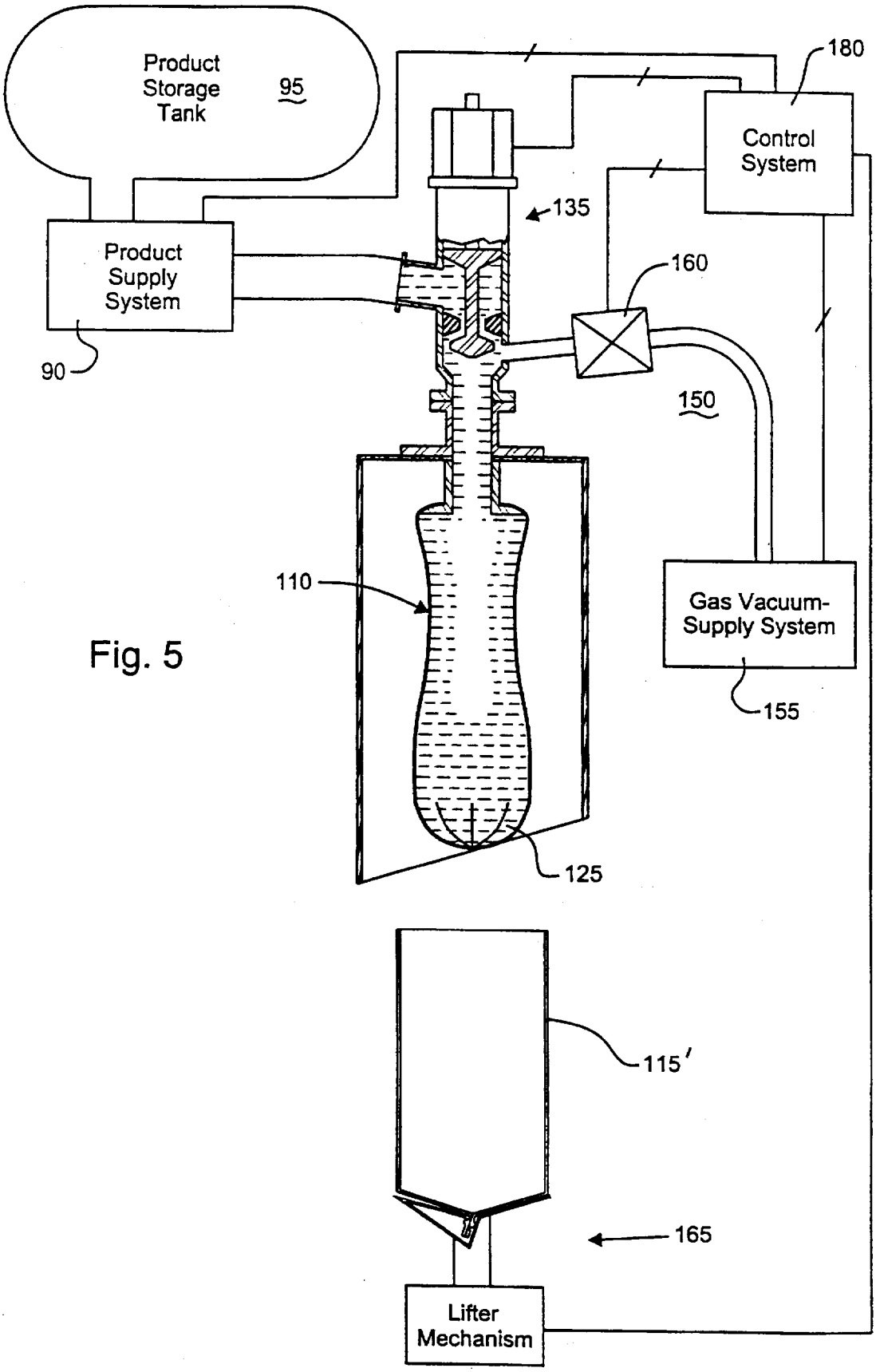

After the container 115 has been filled, the system 75 is operated to refill the flexible dispensing receptacle 110 with the proper volume of product that is to be dispensed into the subsequent container 115'. The pressurization system 150 may have the capability of providing an underpressure to the flexible dispensing receptacle 110 during the refill process. FIG. 5 illustrates use of the pressurization system 150 in such a refill process. As illustrated, product is dispensed into the receptacle 110 thereby displacing air, or another gas. The displaced air is extracted by the pressurization system 150 in a controlled fashion to limit the amount of air/product mixing.

In one embodiment of the system 75, the product is provided to the receptacle 110 in a controlled fashion so as to cause a substantial portion of the product flow to follow the sidewalls of the receptacle 110. The air extracted from the receptacle 110 is controlled in a predefined manner so that the rate of air extracted corresponds to the rate at which the product displaces it within the receptacle. Such control may be provided through programming of the control system 180 which, in turn, may be used to detect flow rates and/or pressures using the appropriate sensors and, further, provide actuation of selected pumps and valves in a predefined manner.

In instances in which the pressurization system 150 only provides an overpressure within the receptacle 110, the valve 160 may be provided with an exhaust that places the interior of the receptacle 110 in fluid communication with the atmosphere when the valve 160 is closed to the gas vacuum-supply system 155. Exhaust of the air displaced from the receptacle 110 during the refill process may also be accomplished using other system components or configurations.

Figure 6:
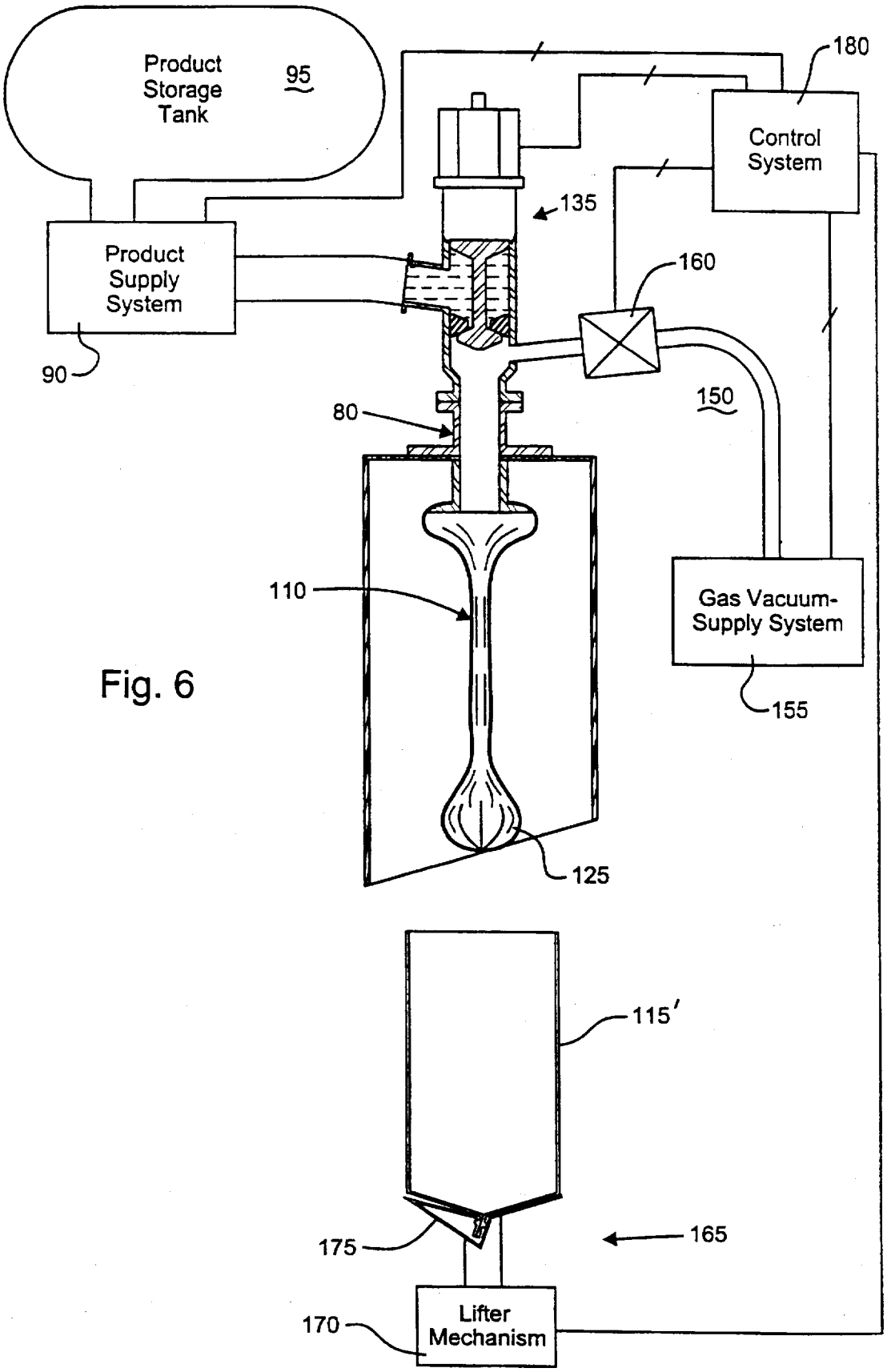

FIG. 6 illustrates a vacuum operation that may take place prior to the refill process. As illustrated, the pressurization system 150 may be operated to create an underpressure in the receptacle 110 prior to dispensing product therein. The resulting underpressure removes air from the receptacle and causes it to collapse in the illustrated manner. The valve 160 is then closed to seal the receptacle 110 from the gas vacuum-supply system 155 and a supply of product is provided to the receptacle 110 from the product supply system 90. Since the product is not displacing air in the receptacle 110, foaming within the receptacle itself is reduced thereby facilitating faster fill rates to the receptacle 110.

Figure 7:
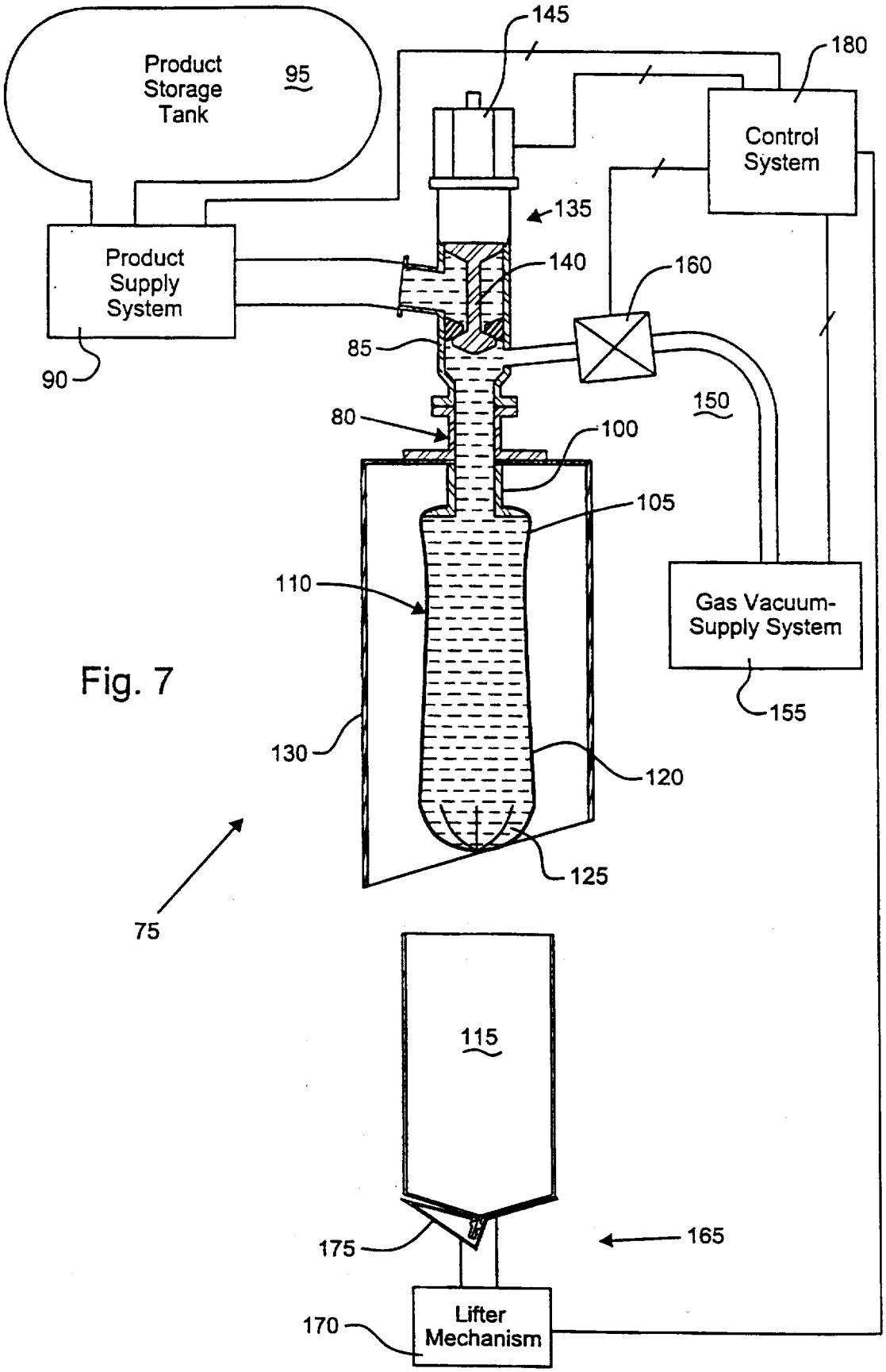

FIG. 7 illustrates a condition of the receptacle 110 in which the receptacle is sized to contain less than the full volume of product that is to be dispensed into the container 115, the remaining volume of product being disposed, for example, in the fill tube 80. In such instances, there is relatively little, if any air, disposed above the product level and, consequently, air/product mixing is further reduced.

FIG. 8 is a perspective view of one embodiment of a pressure actuated nozzle suitable for use in the present system, while FIGS. 8A and 8B are cross sectional views through sections A and B respectively. As illustrated, the nozzle comprises four generally triangular sections 210*a–d* that converge to form a cross-shaped outlet portion 215. A nozzle inlet portion 220 is in the form of an aperture disposed opposite the outlet portion 215. Inlet portion 220 is attached to the resilient receptacle 110 and, for example, may be joined to the flexible receptacle 120 as a separate piece. The nozzle may be formed, for example, from a 40 Duro medical grade silicone material or similarly resilient material. In operation, an overpressure condition is created at the nozzle and the triangular sections are deflected outward so that the cross-shaped outlet portion 215 opens to provide a large cross-sectional fluid outlet. The nozzle returns to the shape illustrated in FIG. 8, with the assistance of its own resilient properties, when the overpressure condition ceases to exist.

Although the present invention has been described with reference to a specific embodiment, those of skill in the art will recognize that changes may be made thereto without departing from the scope and spirit of the invention as set forth in the appended claims.

We claim as our invention:

1. An apparatus for filling a container comprising:

a fill pipe for communicating a product therethrough to a fill opening of the fill pipe;

a flexible dispensing receptacle having a first end disposed about the fill opening of the fill pipe for receiving product communicated through the fill pipe therein, the flexible receptacle capable of being filled with a volume of product that is substantial to the volume of product that is to be dispensed into a single container;

a nozzle disposed at a second end of the flexible receptacle through which product is dispensed into the single container; and a lifter system for lifting the container to insert the flexible dispensing receptacle into the container, and for lowering the container from the flexible dispensing receptacle as the container is filled with the product.

2. An apparatus as claimed in claim 1 and further comprising a pressurization system in fluid communication with the fill pipe, the pressurization system providing an overpressure to the flexible dispensing receptacle to assist in actuating the nozzle to allow dispensing of the product into the container.

3. An apparatus as claimed in claim 2 wherein the pressurization system provides an underpressure to the flow pipe and flexible dispensing receptacle to reduce air/product mixing as the flexible dispensing receptacle is filled with product.

4. An apparatus as claimed in claim 1 and wherein the flexible dispensing receptacle is dimensioned to contact sidewalls of the container as the product is dispensed from flexible dispensing receptacle into the container.

5. An apparatus as claimed in claim 1 wherein the nozzle is integrally formed with the flexible receptacle.

6. An apparatus for filling a container comprising:

a fill pipe for communicating a product therethrough to a fill opening of the fill pipe;

a valve disposed to control communication of the product to the fill pipe;

a flexible dispensing receptacle having a first end disposed about the fill opening of the fill pipe for receiving product communicated through the fill pipe therein, the flexible receptacle capable of being filled with a volume of product that is substantial to the volume of product that is to be dispensed into a single container;

a pressure actuated nozzle disposed at a second end of the flexible dispensing receptacle through which product is dispensed into the single container;

means for actuating the pressure actuated nozzle to dispense product into the single container;

means for lifting the container to insert the flexible dispensing receptacle therein and for lowering the container from the flexible dispensing receptacle as the container is filled with product.

7. An apparatus as claimed in claim 6 and further comprising means for extracting gas from the flexible dispensing receptacle prior to filling thereof of product communicated from the fill pipe.

8. An apparatus as claimed in claim 6 and further comprising control means for coordinating operation of the valve, the means for actuating, and the means for lifting.

9. An apparatus as claimed in claim 7 and further comprising control means for coordinating operation of the valve, the means for actuating, the means for lifting, and the means for extracting.

10. An apparatus as claimed in claim 6 and wherein the flexible dispensing receptacle is dimensioned to contact sidewalls of the container as the product is dispensed from flexible dispensing receptacle into the container.

11. An apparatus as claimed in claim 6 wherein the pressure actuated nozzle is integrally formed with the flexible receptacle.

12. An apparatus for filling a container comprising:

a fill pipe for communicating a product therethrough to a fill opening of the fill pipe;

a flexible dispensing receptacle having a first end disposed about the fill opening of the fill pipe for receiving product communicated through the fill pipe therein, the flexible receptacle capable of being filled with a volume of product that is substantial to the volume of product that is to be dispensed into a single container, the flexible dispensing receptacle being dimensioned to contact sidewalls of the container as the product is dispensed from flexible dispensing receptacle into the container; and a nozzle disposed at a second end of the flexible receptacle through which product is dispensed into the single container.

13. An apparatus as claimed in claim 12 and further comprising a pressurization system in fluid communication with the fill pipe, the pressurization system providing an overpressure to the flexible dispensing receptacle to assist in actuating the nozzle to allow dispensing of the product into the container.

14. An apparatus as claimed in claim 13 wherein the pressurization system provides an underpressure to the flow pipe and flexible dispensing receptacle to reduce air/product mixing as the flexible dispensing receptacle is filled with product.

15. An apparatus as claimed in claim 12 and further comprising a lifter system for lifting the container to insert the flexible dispensing receptacle into the container, and for lowering the container from the flexible dispensing receptacle as the container is filled with the product.

16. An apparatus as claimed in claim 12 wherein the nozzle is integrally formed with the flexible receptacle.

* * * * *